US010040620B1

(12) United States Patent
Hudson et al.

(10) Patent No.: US 10,040,620 B1
(45) Date of Patent: Aug. 7, 2018

(54) SHOE COVER DISPENSING SYSTEMS

(71) Applicant: Cleantrax Products LLC, Far Hills, NJ (US)

(72) Inventors: James Hudson, Baltimore, MD (US); Steven Levine, Far Hills, NJ (US); Christopher Sidebotham, Mendham, NJ (US)

(73) Assignee: Cleantrax Products LLC, Far Hills, NJ (US)

( * ) Notice: Subject to any disclaimer, the term of this patent is extended or adjusted under 35 U.S.C. 154(b) by 192 days.

(21) Appl. No.: 14/683,975

(22) Filed: Apr. 10, 2015

Related U.S. Application Data

(60) Provisional application No. 61/985,297, filed on Apr. 28, 2014, provisional application No. 61/978,036, filed on Apr. 10, 2014.

(51) Int. Cl.
*B65D 83/08* (2006.01)
*A43B 3/16* (2006.01)

(52) U.S. Cl.
CPC ..... *B65D 83/08* (2013.01); *A43B 3/16* (2013.01)

(58) Field of Classification Search
CPC ..... B65D 83/08; B65D 85/62; B65H 1/00; A43B 3/16
See application file for complete search history.

(56) References Cited

U.S. PATENT DOCUMENTS 3,775,793 A * 12/1973 Casavant ..... A43B 3/163 12/1 R
4,066,194 A * 1/1978 Leland ..... A47G 25/905 223/111
5,593,071 A * 1/1997 Lusk ..... A47G 25/905 223/111
6,543,075 B2 4/2003 Gultekin et al.
7,448,521 B2 11/2008 Hu
7,669,351 B1 * 3/2010 Ghotbi ..... A43B 3/163 12/1 R
7,757,910 B2 7/2010 Levine et al.
8,186,548 B2 * 5/2012 Levine ..... A43B 3/16 12/1 R
8,490,842 B2 * 7/2013 Xu ..... A43B 3/106 12/1 R
2007/0163912 A1 * 7/2007 Chen ..... A43B 3/16 206/477
2008/0000035 A1 * 1/2008 Levine ..... A43B 3/16 12/1 R
2008/0237277 A1 10/2008 Xu
2009/0152312 A1 * 6/2009 Li ..... A43B 3/16 223/113
2010/0257749 A1 * 10/2010 Levine ..... A43B 3/16 36/7.1 R (Continued)

FOREIGN PATENT DOCUMENTS

JP 2006-094990 4/2006

*Primary Examiner* — Gene O Crawford
*Assistant Examiner* — Kelvin L Randall, Jr.
(74) *Attorney, Agent, or Firm* — Klarquist Sparkman, LLP

(57) ABSTRACT

Disclosed shoe cover dispensers function in conjunction with a cartridge of pre-stacked shoe covers utilizing an improved loading process, making the process easier and faster for the user. The cartridge can be inserted into the dispenser and then expanded by the dispenser to achieve a stack of expanded shoe covers ready to be automatically released over a shoe when the shoe is placed inside the dispenser.

20 Claims, 15 Drawing Sheets

(56) References Cited

U.S. PATENT DOCUMENTS

2010/0288800 A1* 11/2010 Xu ..... A43B 3/106
223/113
2016/0107824 A1* 4/2016 Xu ..... A43D 999/00
221/56

* cited by examiner

FIG. 5A
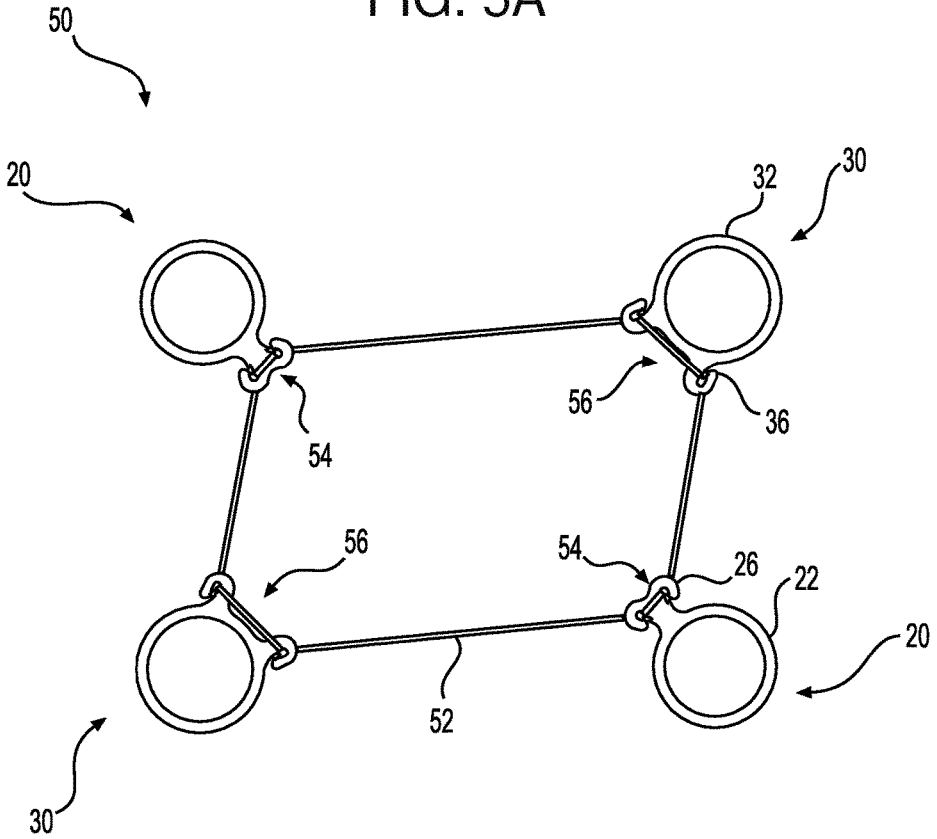
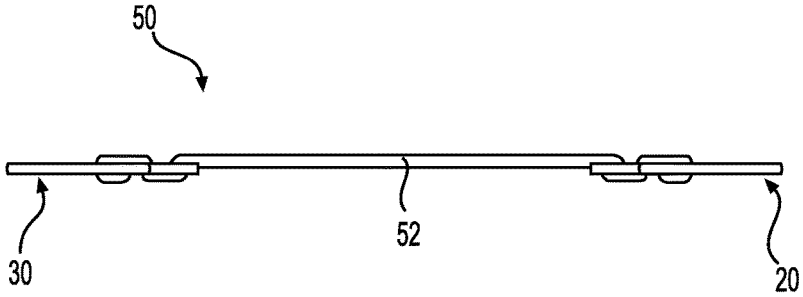
FIG. 5B

240

SHOE COVER DISPENSING SYSTEMS

CROSS REFERENCE TO RELATED APPLICATION

This application claims the benefit of U.S. Provisional Patent Application No. 61/985,297, filed Apr. 28, 2014, and claims the benefit of U.S. Provisional Patent Application No. 61/978,036, filed Apr. 10, 2014, both of which are incorporated herein by reference in their entirety.

FIELD

This disclosure pertains to shoe cover dispensing systems.

BACKGROUND

In some shoe cover dispensers, shoe covers are stacked inside of dispensers with clips at each of the four corners of every shoe cover and with the clips connected by an elastic band. FIGS. 1 and 1A show exemplary shoe covers 2 having clips 4 connected by elastic bands 6. The clips 4 work in conjunction with a dispensing mechanism to hold a flexible cloth, fabric or paper shoe covering portion 10 of the shoe covers in an expanded, non-deployed position. A foot may then be placed within the boundary of the cover and the dispenser can release the shoe cover from the four corner clips. The elastic band 6 is released from within the clips, thereby causing the shoe covering portion 10 to collapse and be secured around the shoe.

Shoe cover dispensers utilize various clip designs. Exemplary clips are shown in FIG. 2. On each dispenser, the particular clip design of choice is secured at all four corners of each shoe cover in the stack. Thus, an elastic band held within a given clip lies directly atop a corresponding elastic band from the clip below. As shown in FIGS. 3A and 3B, this tends to create tall, inefficient stacks due to the thickness of the elastic bands, leaving large spaces in between the shoe covers unused. Furthermore, the thick elastic bands prevent the clips from sitting directly on top of each other in a parallel position, and instead cause the top and bottom clips to be angled with respect to each other. This condition can cause jamming and interference with dispenser function. Simply compressing the shoe covers together only exaggerates this condition by further reducing the height of the stack at the outer edge (at the clips) relative to where the clip attaches to the elastic bands.

It would be advantageous to be able to consistently include more shoe covers within a given stack, while improving dispenser function. Increasing the number of shoe covers within each stack, without changing the height of the stack, can allow a single dispenser of modest size to provide a large number of shoe covers, such as for large events, while reducing the need to frequently replenish the dispenser with covers.

It would also be advantageous to not have to manually load each shoe cover one at a time into a dispenser.

SUMMARY

Disclosed herein are novel shoe covers, disposable cartridges of pre-stacked shoe covers, and shoe cover dispensers that function in conjunction with a cartridge of pre-stacked shoe covers. The dispensers utilize an improved loading process, making the overall shoe cover dispensing process easier and faster for the user. A cartridge of non-expanded shoe covers can be inserted into the dispenser and then expanded by the dispenser to achieve a stack of expanded shoe covers ready to be automatically released over a shoe when the shoe is placed inside the dispenser.

Disclosed shoe cover dispensing systems can comprise a rigid body having an upper opening configured to receive a cartridge containing a plurality of pre-stacked shoe covers in a collapsed state, an expansion system configured to elastically expand the received plurality of shoe covers in a received cartridge from the collapsed state to an expanded state, and a releasing system configured to detect the presence of a shoe within the body and automatically release one of the plurality of shoe covers from the expanded state such that the released shoe cover elastically closes around the detected shoe.

The releasing system can comprise a sensor or switch that detects the presence of a shoe positioned inside the body. In some embodiments, the releasing system comprises rotating feed cams that are configured to release a top-most shoe cover in the stack when the feed cams rotates, which can occur in response to the sensor or switch detecting the presence of a foot inside the dispenser. The releasing system can also be configured to detect that a shoe has been removed from the body after a shoe cover has been released onto the shoe, and the dispenser can then move another shoe cover into a position ready to be released onto another foot that is subsequently placed into the body.

The expansion system can comprise a plurality of poles or other structures that extend generally vertically into a received cartridge of shoe covers. For example, the plurality of poles can enter respective stacks of shoe cover clips at the corners of the cartridge. The expansion system can include at least one motor that drives the poles apart from each other to expand the shoe covers. In some embodiments, the expansion system includes at least one motor that drives the poles apart from each other in a first horizontal dimension and at least a second motor that drives the poles apart from each other in a second horizontal dimension that is different from the first horizontal direction. The expansion system can be configured to fracture a disposable frame or packaging of the cartridge while expanding the shoe covers.

Disclosed cartridges can comprise a plurality of elastically expandable shoe covers in a non-expanded state and a disposable frame positioned at least partially around the shoe covers, wherein the disposable frame contains the shoe covers in a stacked relationship in the non-expanded state yet permits the shoe covers to be expanded from the non-expanded state to an elastically expanded state by a shoe dispensing system. For example, the disposable frame can comprise at least one weakened portion that is configured to fracture when the shoe covers are expanded by a shoe cover dispensing system from the non-expanded state to an elastically expanded state. The cartridge can contain the shoe covers in a stacked pattern such that rings coupled to elastic portions of the shoe covers are stacked in columns at the corners of the cartridge, which allows the poles of the dispenser to be inserted into the columns of rings from the bottoms of the columns. In each column, there can be two or more different types of rings ordered in an alternating pattern to help position the elastic portions of the shoe covers in such a manner that allows the entire stack of shoe covers to be shorter, having more shoe covers per vertical dimension unit of the stack.

Disclosed shoe covers can comprise a sheet of flexible material configured to at least partially cover a shoe, an elastic portion coupled to the sheet of flexible material and configured to retain the sheet of flexible material on a shoe, and a plurality of rings coupled to the elastic portion and configured to engage an expansion mechanism, wherein moving the plurality of rings apart from each other causes the elastic portion to elastically expand to open the shoe cover for receiving a shoe, and wherein releasing the a plurality of rings allows the elastic portion to elastically contract to close the shoe cover on a shoe. The elastic portion can comprise an annular elastic band forming an expandable opening of the shoe cover, and the plurality of rings can be spaced around a perimeter of the annular elastic band. The a plurality of rings are configured to be positioned around receiving poles of an shoe dispenser such that separation of the receiving poles causes elastic expansion of the elastic portion of the shoe cover. The plurality of rings can comprise at least two differently shaped rings that nest with one another such that the differently shaped rings can be organized in an alternating pattern in stacked columns of rings in the cartridge.

The foregoing and other objects, features, and advantages of the disclosed technology will become more apparent from the following detailed description, which proceeds with reference to the accompanying figures.

BRIEF DESCRIPTION OF THE FIGURES

FIG. 4A is a top view of a first, long clip having a single, common stem with two prongs for holding a first band. FIG. 4B is a top view of a second, short clip having two stems spread apart, each stem having a prong for holding a second band. FIG. 4C is a top view of the clips of FIG. 4A and FIG. 4B, in a vertically stacked configuration, holding the two bands.

FIG. 5A is a top view and FIG. 5B is a side view of an exemplary shoe cover (shoe covering material omitted) having four clips and an elastic band. Exemplary dimensions are provided in the top view, in inches and millimeters (in brackets).

DETAILED DESCRIPTION

Exemplary Shoe Covers and Shoe Cover Clips

Disclosed herein are shoe cover clips capable of nesting with respect to one another to optimize the stacking of shoe covers. This nesting can be accomplished with the use of two or more specifically designed clips, which can have similar end portions for interacting with the mechanism in the dispenser but have different engagement projections for an elastic member (such as different attachment sites for an elastic and/or elastic band). Differences in elastic band attachment sites allow for staggering of elastic bands, such that they do not rest on top of each other to create spatially inefficient stacks in the vicinity of the clips. Rather, the elastic bands can be configured to rest one in front of the other, in the same transverse plane or in different planes, in the vicinity of the clips. This staggering can reduce the overall height of a stack of shoe covers by a significant amount. In various embodiments, the height reduction achieved is at least about 33%, at least about 30%, at least about 25%, at least about 20%, or at least about 15%.

Figure 1:
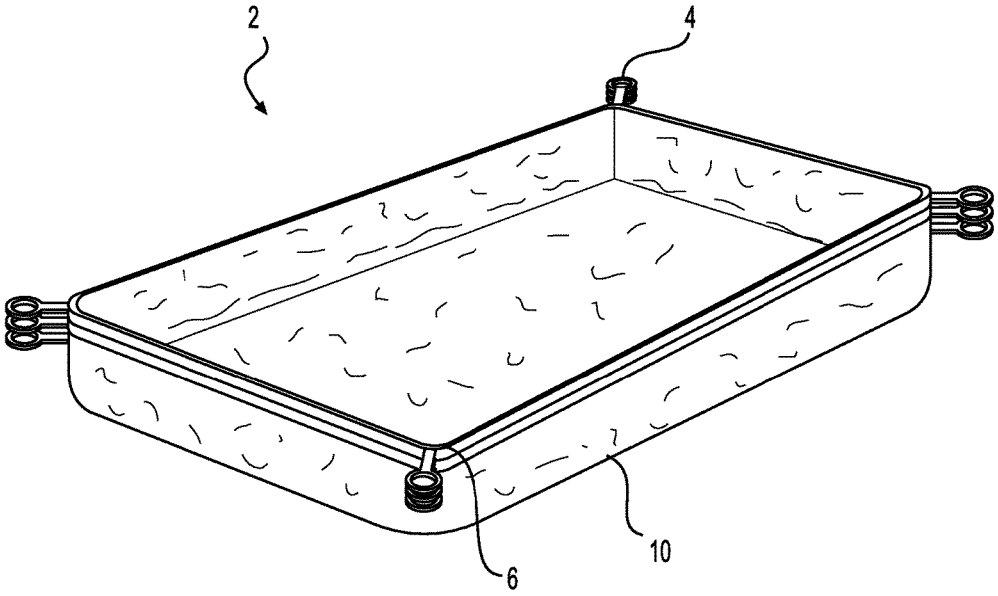
FIG. 1 is a perspective view of several nested shoe covers (with a cover dispensing device omitted), each having four identical clips located at four corners of the cover.
Figure 1A:
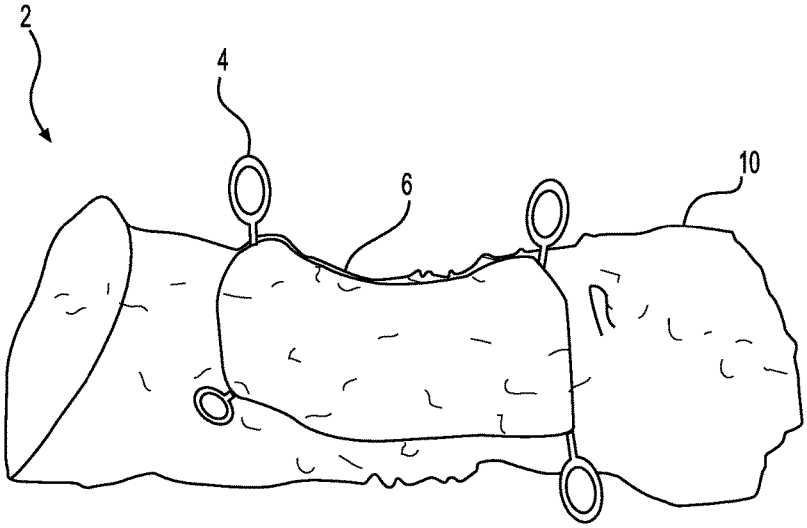
FIG. 1A shows an exemplary shoe cover with clips attached.
Figure 2:
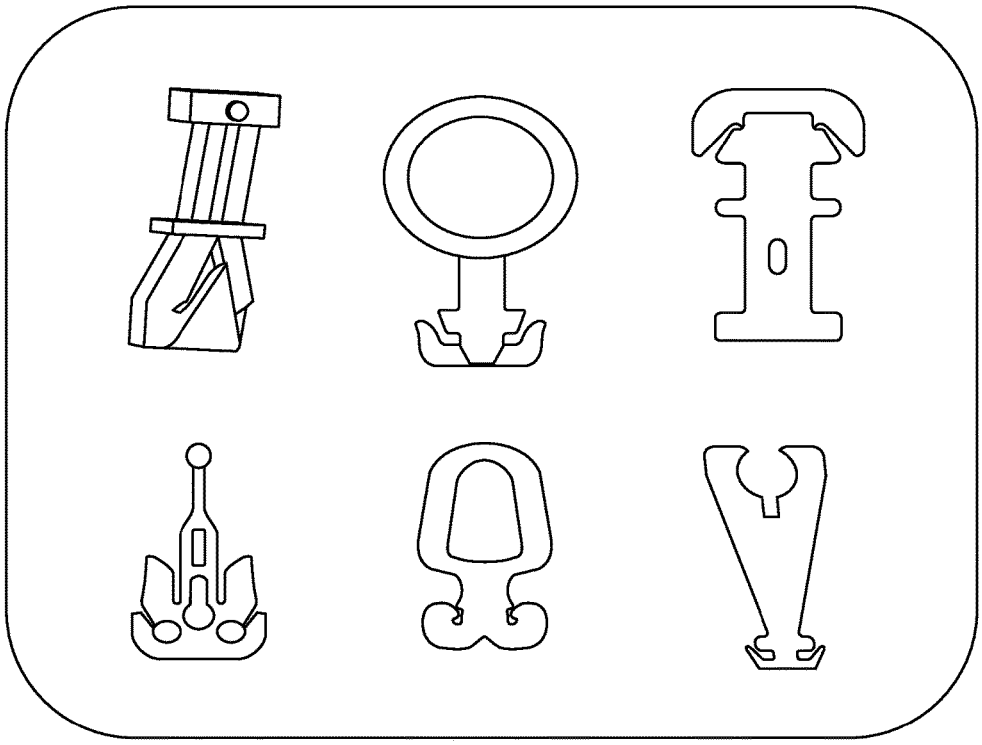
FIG. 2 shows six examples of shoe cover clips.
Figure 3A:
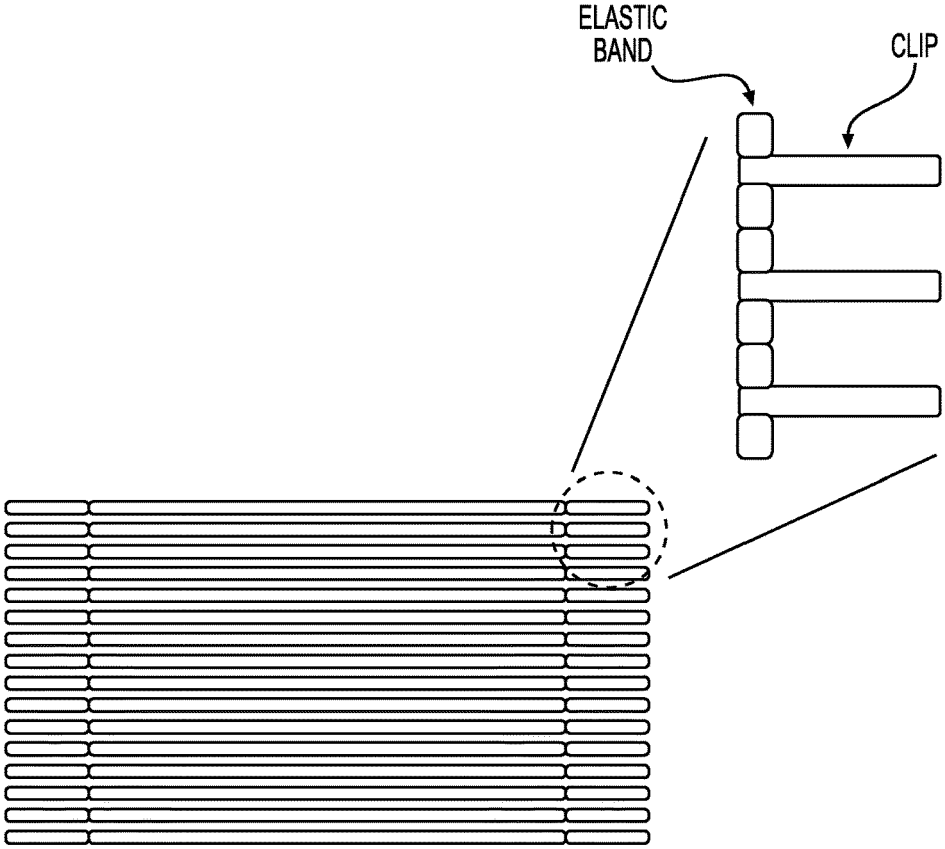
FIG. 3A is a side schematic view of a stack of shoe covers with clips, each shoe cover according to FIG. 1, and an enlarged schematic view of three vertically adjacent clips from the stack of shoe covers, with elastic bands extending through the clips to stack atop one another and the clips.
Figure 3B:
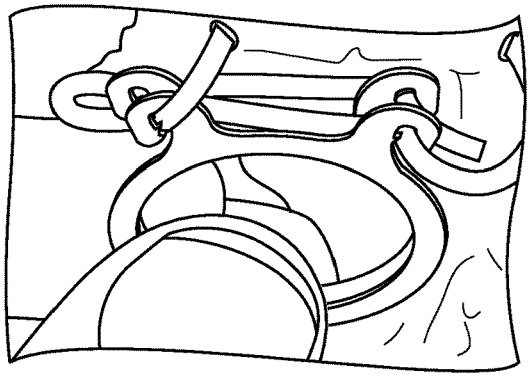
FIG. 3B shows two vertically adjacent clips and elastic bands located at the corners of two stacked shoe covers, with elastic bands stacked atop one another and the clips.
Figure 4A:
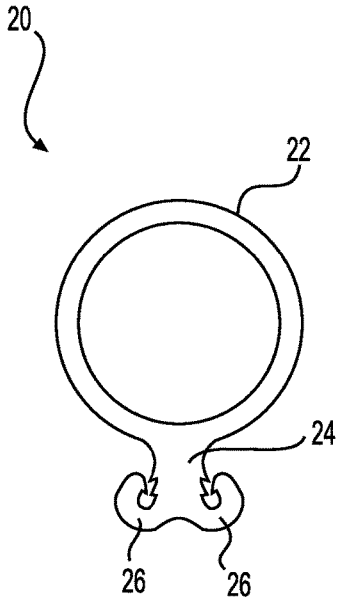
FIGS. 4A-4C show an exemplary set of clips for efficient stacking of the shoe covers.
Figure 4B:
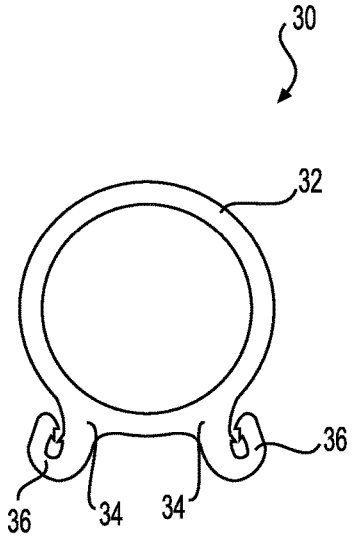
Figure 4C:
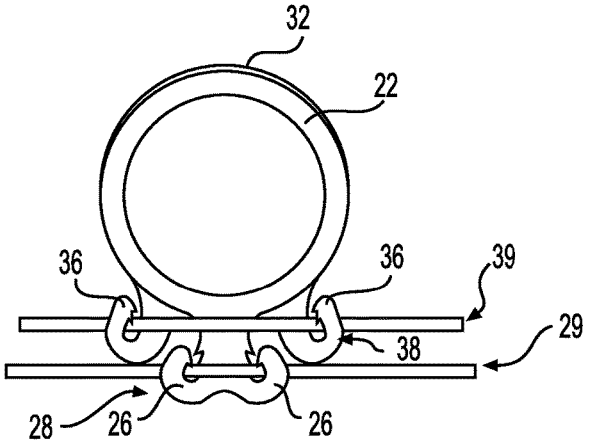

FIGS. 4A-4C show an exemplary set of clips for efficiently stacking individual shoe covers. FIG. 4A shows a first, long clip 20 having a circular end portion 22 which interacts with the dispensing mechanism/actuator and a common stem 24. The common stem 24 can comprise at its terminus two opposing prongs 26 for holding an elastic band that surrounds a shoe covering portion (not shown) of the shoe cover. The stem 24 can extend radially outward from a location along the outer perimeter of the circular end portion 22. The prongs 26 can each project sideways, away from the axis of the stem 24, in opposite directions. The prongs 26 can together form a channel 28 for holding an elastic band in place, such as elastic band 29 shown in FIG. 4C.

FIG. 4B shows a second, short clip 30 having a circular end portion 32 and two stems 34 projecting radially outward an equivalent distance from two locations spaced apart along the outer perimeter of the circular end portion 32. This distance (i.e., the length of these stems 34) is desirably shorter than the length of the stem 24 of the long clip 20. The two stems 34 can each have a prong 36 and form an open channel 38 for holding in close proximity to the short clip 30 a second elastic band, such as the elastic band 39 shown in FIG. 4C, that extends between the two prongs 36. In some embodiments, the prongs 36 attach directly to the outer perimeter of the end portion 32.

FIG. 4C shows the long clip 20 stacked on top of the short clip 30. Due to their shorter length, as shown, the stems 34 of the short clip 30 can hold elastic band 39 at locations radially inward (relative to the center of the circular end portions 22, 32) of the elastic band 29 retained by the long clip 20. Thus, the radially spaced elastic bands 29, 39 do not stack in the vicinity of the clips 20, 30. Furthermore, the stems 34 can be spaced apart by a distance that is slightly greater than the distance between prongs 26. By having such spacing, the stems 34 and/or the prongs 36 can, in some cases, be biased or otherwise configured to project upward, such that at least a portion of the prongs 36 holding the second elastic band 39 shares substantially the same transverse plane as at least a portion of the prongs 26 holding the first band 29. In some embodiments, rather than the stems 34 projecting upward towards the long clip 20, the stem 24 of the long clip 20 can project downward towards the short clip 30. In some embodiments, the heights of the prongs 26, 36 are each no greater than the combined height of the two end portions 22, 32. A "transverse plane" as used herein refers to a plane extending in a latitudinal direction, perpendicular to the axis of the stack of shoe covers and parallel to the individual shoe covers.

Figure 6:
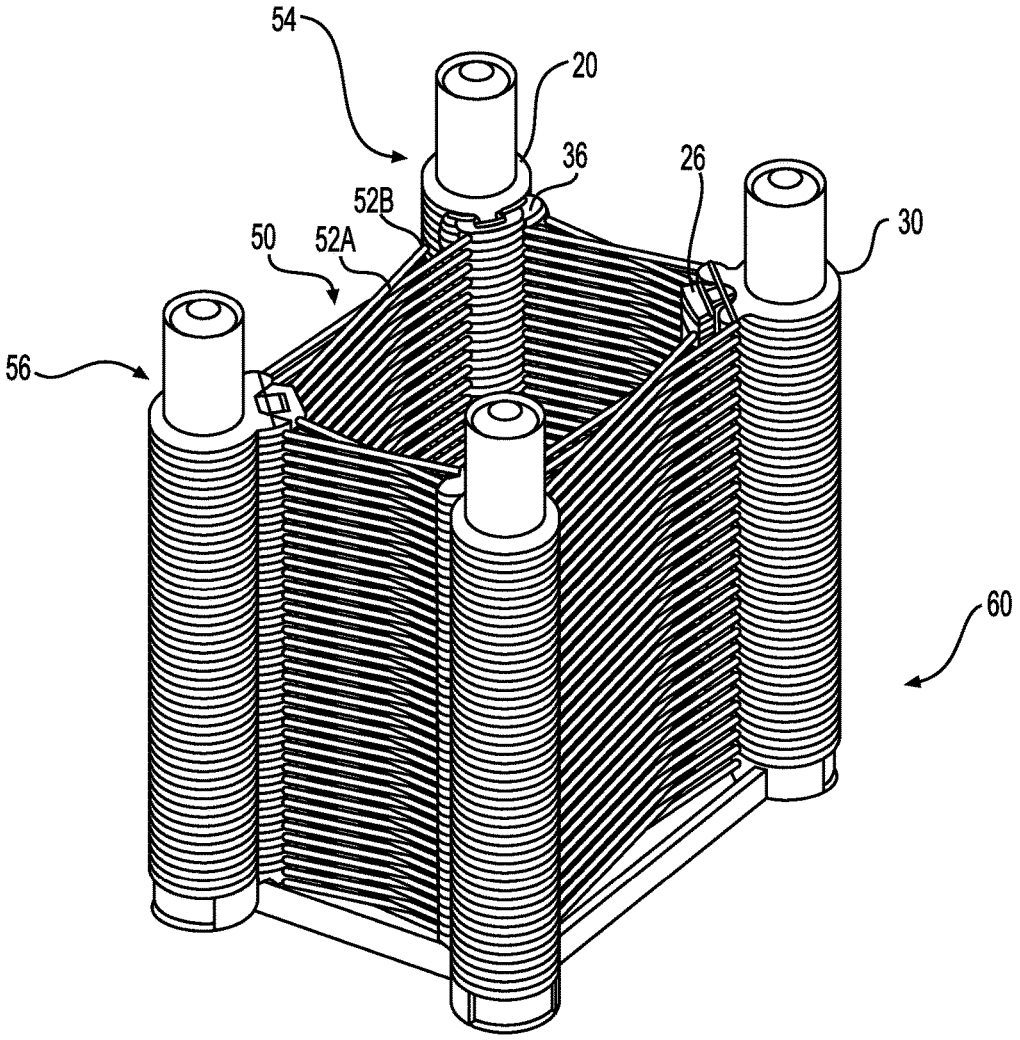
FIG. 6 is a perspective view of a cartridge loaded with shoe covers having clips configured as shown in FIG. 4C, with the shoe covering portions removed for illustration.

In addition to having long clips 20 stacked on top of short clips 30, a stack of shoe covers can also have short clips 30 stacked on top of long clips 20 (FIG. 6). In this case, the stem 24 of the long clip 20 can project upwards towards the short clip 30, or the stems 34 can project downwards, outside of the stem 24, towards the long clip 20. Any arrangement of alternating clip types can be used.

In other embodiments, the clips 20, 30 can each remain completely in its own transverse plane, while stacked directly on top of the other with each clip 20, 30 carrying an elastic band within its respective channel 28, 30. In some of these embodiments, the channel 28 and/or the prongs 26 has a height no greater than the height of the end portion 22 of the long clip 20, and the channel 38 and/or the prongs 36 has a height no greater than the end portion 32 of the short clip 30. In various embodiments, the stems 34 can be spaced closer or further apart, along the outer perimeter of the end portion 32. In some embodiments, the stem 24 is shorter than each of the stems 34, thereby rendering clip 20 (with a single stem) the "short clip" and clip 30 (with dual stems) the "long clip."

FIGS. 5A and 5B show an exemplary shoe cover 50 (shoe covering material omitted) with an elastic band 52 and four clips located at its four corners 54, 56. Each shoe cover 50 can have a mixed collection of clips, such as two clips 20 and two clips 30. The two clips 20 can be located at diagonally opposite corners 54, with the two clips 30 located at the other two corners 56 (also diagonally opposite from one another). As a result, the elastic band 52 extending around the clips 20, 30 can form the general shape of a slanted parallelogram. In particular, each elastic band 52 can extend in an angled direction, slightly inward or slightly outward relative to the center of the shoe cover 50, between the clip prongs 36 and 26. The present disclosure should not be construed as limited to shoe covers with elastic bands forming such a shape between clips. Other shapes can be formed in conjunction with clips, which may involve greater than four primary corners, such as six or eight corners.

FIG. 6 shows a stack of individual shoe covers 50 (shoe covering material omitted) with clips 20, 30 loaded onto a cartridge 60, which in turn can be loaded into a shoe cover dispenser (such as described below). The shoe covers 50 can all be loaded directly onto the cartridge 60 in the slanted parallelogram configuration. The orientation of the shoe covers 50 can alternate within the stack, such that, at each corner of the stacked shoe covers (i.e., at each corner of the cartridge 60), the stacked clips switch back-and-forth between clips 20 and clips 30. The elastic bands 52A and 52B of vertically adjacent shoe covers 50 can cross past one another along the side of the cartridge 60, but are prevented from crossing in the vicinity of the clips 20, 30. Thus, as a result of this alternating arrangement, the elastic bands 52A, 52B of vertically adjacent shoe covers 50 are prevented from piling on to each other and the clips 20, 30 at the corners 54, 56. The clips 20, 30 are thereby permitted to stack directly on top of one another in a substantially parallel configuration. In various embodiments, at none of the corners 54, 56 is the height associated with stacking two shoe covers 50 greater than the height of the two stacked clips 20, 30 at their respective end portions 22, 32.

In other embodiments, each individual shoe cover comprises only one variety of clip (e.g., either four clips 20 at each corner or four clips 30 at each corner), with the type of clip alternating between vertically adjacent covers within the stack. The shoe covers having different clips 20, 30 can be efficiently stacked atop one another (i.e., no stacking of the elastic bands at the clips), though there may be a difference in the level of tension in the elastic bands 52 and/or the shoe covering portions. For example, a shoe cover with four clips 30 may hold an elastic band and/or the shoe covering material in greater tension than a shoe cover with four clips 20, due to the shorter length of the stems 36 compared to stems 26. Alternatively, the shoe covers can be made to vary slightly in the dimensions of the shoe covering portion and/or the size or type of elastic band used.

Exemplary Shoe Cover Dispensing Systems and Methods

Shoe covers are used in many industries including medicine (e.g., in operating rooms), electronics (e.g., in clean rooms) and real estate (e.g., for viewing homes). Applying shoe covers to the foot is an operation which varies from the user stretching it over their shoe by hand to a dispenser which will apply the cover over the shoe automatically. In the latter example, a dispenser can be a mechanically designed unit or an electro-mechanical unit in the operation of dispensing the cover. In some shoe cover dispensers, loading the shoe covers into the dispenser is done individually by stretching the covers and inserting corner clips into the dispenser mechanism. This is a very time consuming and error prone process, and must be performed multiple times in order to fill the dispenser with shoe covers. In other shoe cover dispensers, a column of folded shoe covers is loaded into a dispenser and the shoe covers are fed one-by-one into a mechanism which allows users to stretch each dispensed cover by using the heel of the shoe to pull one end of the cover and stretching it over the toe of the shoe. However, this is also a time consuming and error prone process.

As an improvement to this art, disclosed shoe cover dispensers function in conjunction with a cartridge of pre-stacked shoe covers utilizing an improved loading step, making the process easier and faster for the operator. The cartridge can be inserted into the dispenser and then expanded by the dispenser to achieve a stack of expanded shoe covers ready to be automatically released over a shoe when the shoe is placed inside the dispenser.

Figure 7:
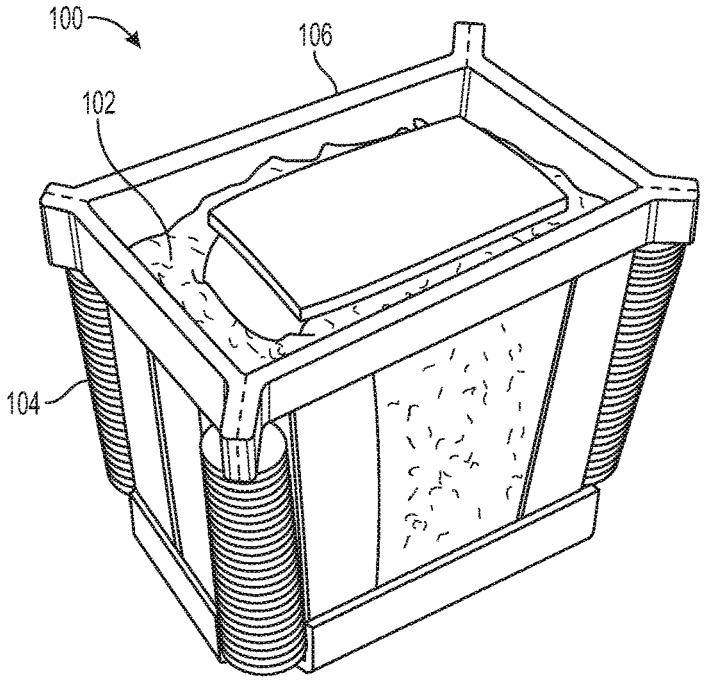
FIG. 7 is a top perspective view of another exemplary shoe cover cartridge.
Figure 8:
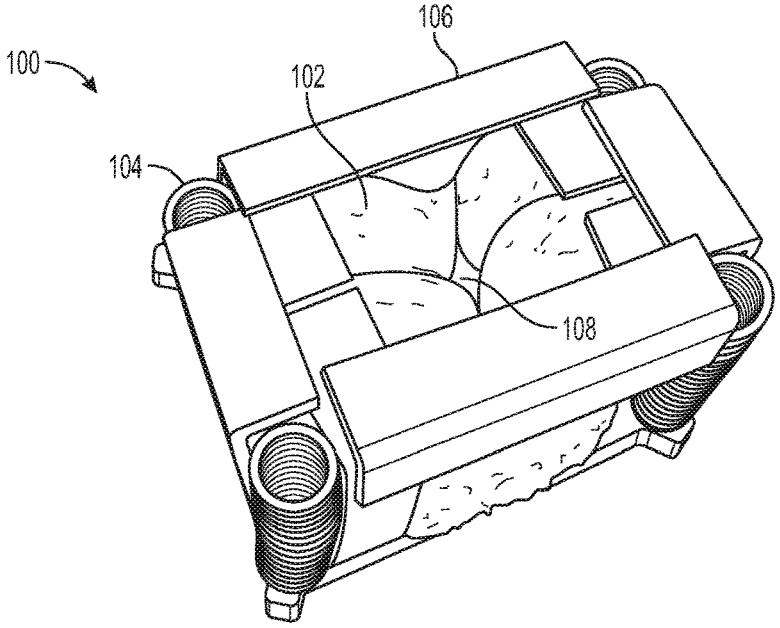
FIG. 8 is a bottom perspective view of the shoe cover cartridge of FIG. 7.

FIGS. 7 and 8 show an exemplary cartridge 100 including a stack of shoe covers 102 each having four clips 104 and an elastic band running through the four clips, and a covering material (e.g. plastic). The shoe covers 102, clips 104, elastic band, and covering material can be identical to or similar to the technology shown and described in related to FIGS. 4A-6. The clips 104 form four vertical stacks at the four corners of the cartridge 100. As shown in FIG. 8, the clip stacks can be hollow to receive vertical loading rods of a dispenser from the bottom of each stack.

The shoe covers 102 are held in the cartridge 100 by a frame 106 (e.g., disposable packaging), which can comprise polymeric material, cardboard, and/or other suitable materials. The frame 106 holds the shoe covers 102 in a compact state with the elastic bands relaxed. The frame 106 can be perforated at certain locations, or otherwise readily fracturable, such that the frame 106 can be fractured, broken apart, torn, or otherwise opened by a dispenser in order to expand the four columns of clips 104 diagonally apart from each other and ready the covers 102 to receive a shoe. For example, the frame 106 can be readily fracturable along the four upper corners of the frame (shown in FIG. 7 above the stack of clips 104) such that the four side panels of the frame separate from each other and move (e.g., pivot or slide) downwardly when the cartridge is expanded outwardly. The four side panels can pivot about the lower edges where they join the bottom panel (shown in FIG. 8). This allows the remnants of the frame 106 to reside at the bottom of a dispenser during the dispensing of the shoe covers. When the shoe covers are all dispensed, the remnants of the frame become accessible and can be readily removed so a new cartridge can be loaded into the dispenser. In other embodiments, at least part of the remnants of the frame can be removed after expansion of the covers and before the covers are dispensed. The bottom panel of the frame 106 can have a central opening 108 that allows a portion of the dispenser to be inserted up into the cartridge when it is loaded into the dispenser.

Figure 9:
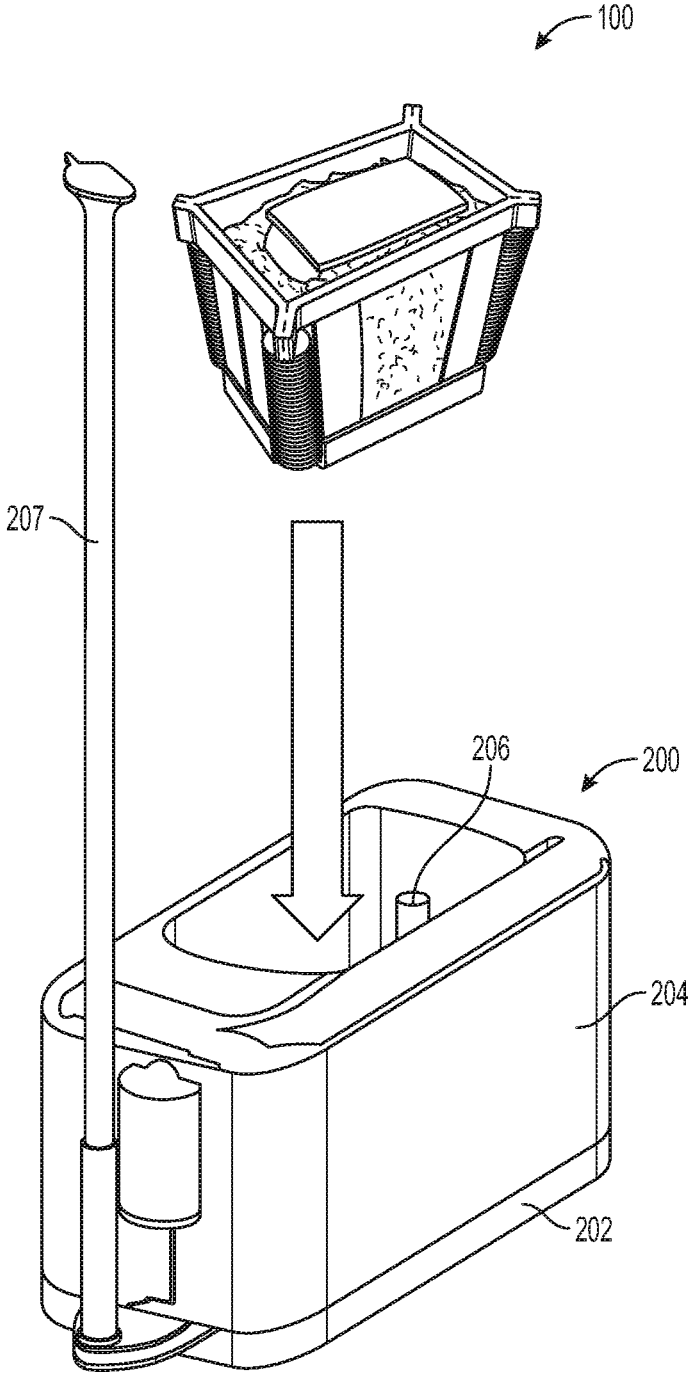
FIG. 9 shows an exemplary shoe cover dispenser with the shoe cover cartridge of FIG. 7 ready to be inserted into the dispenser.

FIG. 9 shows a cartridge 100 being loaded into an exemplary shoe cover dispenser 200. The cartridge 100 is inserted into the dispenser 200 in the same location as where the shoe is inserted. The dispenser 200 then expands the shoe covers 102 in the cartridge 100 horizontally to a stretched position sufficiently large enough for a shoe to be placed within the borders of the cover. In expanding the shoe covers 102, the dispenser 200 can apply sufficient force to fracture the frame 106 of the cartridge. When the covers are expanded, the dispenser is ready for use. When a user places her shoe into the top opening of the dispenser within the boundaries of the covers and applies a downward load through the covers, a switch (e.g., pressure sensitive) of the dispenser triggers the release of one shoe cover 102 (e.g., the upper most and/or inner most cover) by disengaging each of the corner clips 104 of that cover substantially simultaneously. The cover then elastically closes around the users foot, after which the user can remove her foot with the cover applied. The dispenser can then cause a next shoe cover in the stack to move into a ready-to-be-deployed position, and the process can repeat until all the covers are dispensed. Then the remnants of the frame can be removed (if still present) and a new cartridge can be inserted and the entire process can be repeated.

In some embodiments, the dispenser 200 includes a mechanism 202 (shown in FIGS. 10-14) positioned within an outer body 204 (FIG. 9). Mechanism 202 is just one non-limiting example, and many variations of this embodiment can be utilized to perform equivalent functions, as are described herein. The mechanism 202 includes four vertical posts 206 that can move diagonally horizontally apart from and towards each other through a specific combination of x-direction and y-direction movements driven by a central horizontal auger 210 mounted above a lower base plate 204. This allows the four posts 206 to move between the contracted loading position shown in FIGS. 10-12 and the expanded dispense position shown in FIGS. 13-14.

The dispenser 200 can be powered by at least one on-board power supply 220 (e.g., a rechargeable battery) and/or a corded power supply. For example, the power supply may include a 12V solid lead acid rechargeable battery, or a power cord that plugs into a wall outlet. An on-board power supply can allow the dispenser 200 to be mobile and not depend on its location having a power outlet. The power supply can power various motors (e.g., motors 212, 230, 242) and one or more electrical controllers (e.g., on circuit board 252) coupled to the motors. A master power switch 250 and/or other user operated switches/control devices can also be included.

Figure 10:
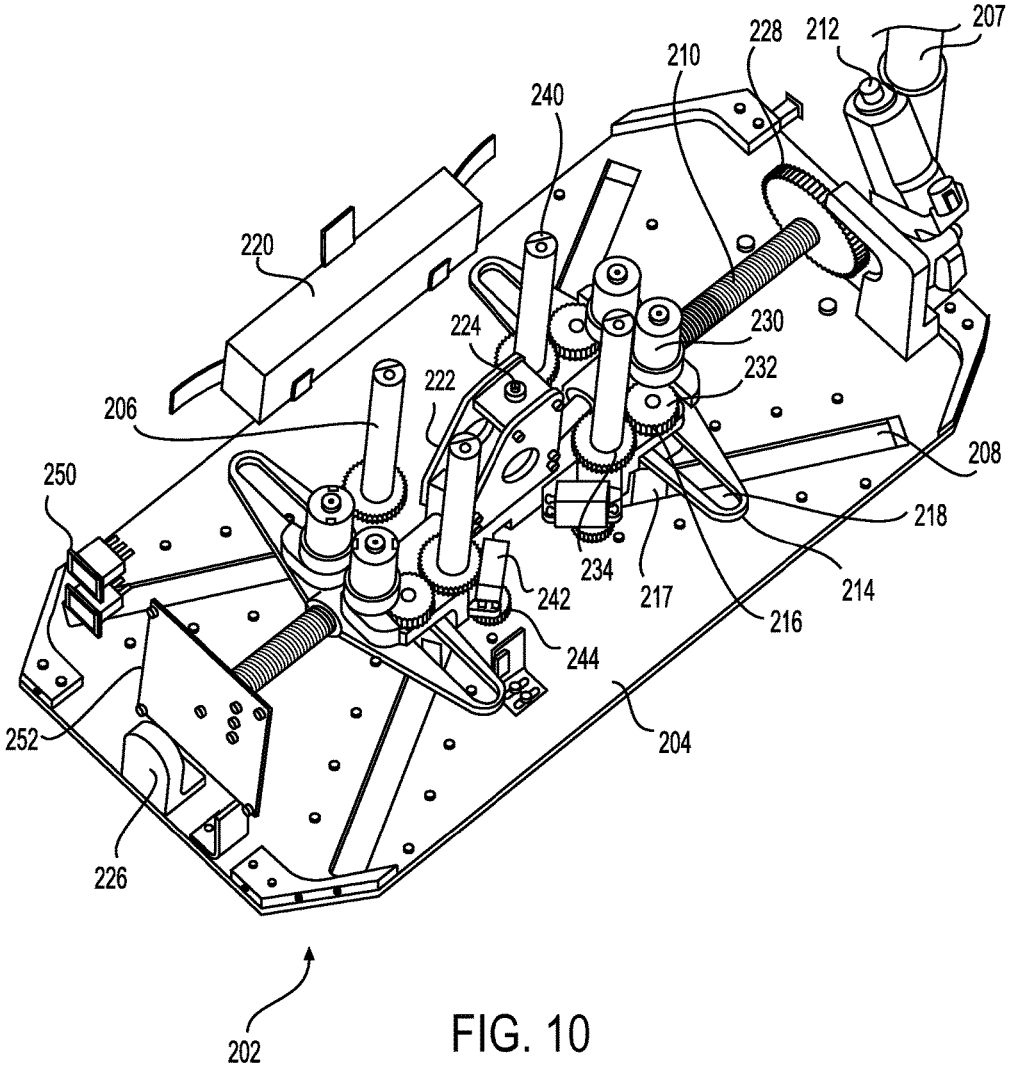
FIG. 10 is a perspective view of a mechanism of the shoe cover dispenser of FIG. 9 in a loading position, ready to receive a shoe cover cartridge.
Figure 11:
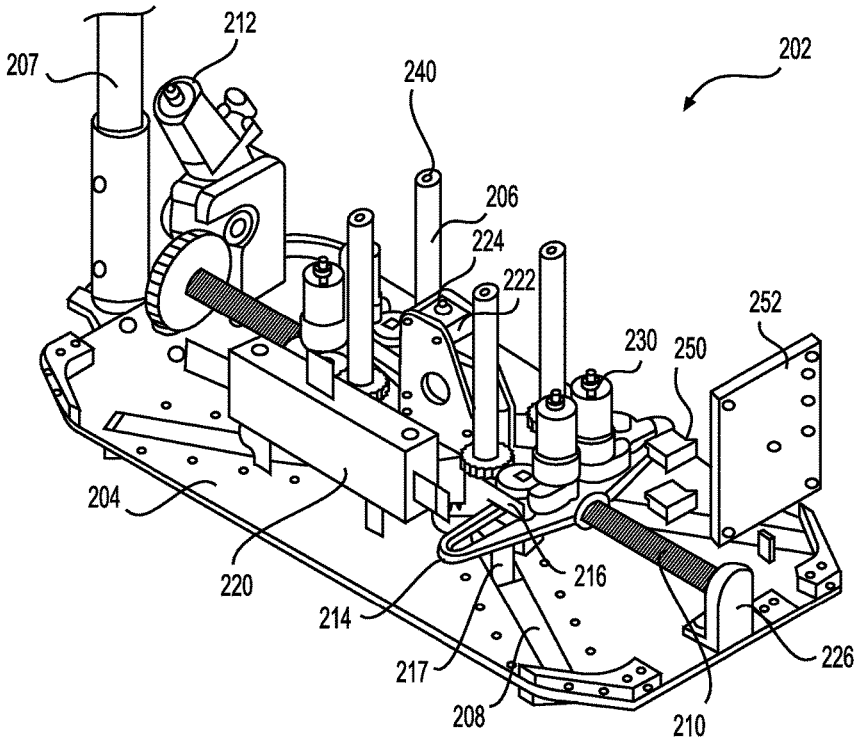
FIG. 11 is another perspective view of the mechanism of FIG. 10 in the loading position.
Figure 12:
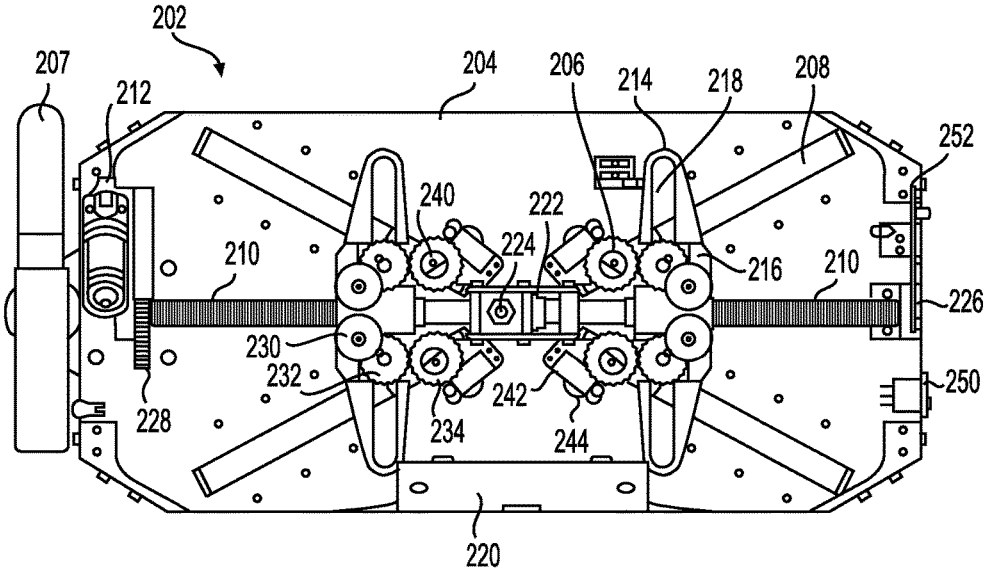
FIG. 12 is a top view of the mechanism of FIG. 10 in the loading position.

To load the cartridge 100 into the dispenser 200, the four columns of clips 104 of the cartridge are slid over the tops of the four posts 206 and down toward the base plate 204 when the mechanism 202 is in the contracted, load position (FIGS. 10-12). Once the cartridge 100 has been loaded, the dispenser 200 moves the posts 206 diagonally outward to the dispense position (FIGS. 13-14), fracturing/breaking the frame 106 of the cartridge that is used to organize the covers within the cartridge. For example, the frame 106 can fracture along perforations located at or near the bottom of the frame, allowing the sides and bottom of the frame to move upwardly to the top of the covers 102 when the covers are expanded. In other embodiments, the frame 106 can fracture along perforations located at or near the bottom of the frame, allowing the sides and bottom of the frame to move upwardly to the top of the covers 102 when the covers are expanded. Once the covers are fully expanded by the dispenser 200, the remnants of the frame 106 can become a generally flattened material and can be located near the top of the expanded covers and/or near the bottom of the dispenser, such that the frame remnants can be easily accessed and removed from the dispenser 200. In some embodiments, portions of the fractured frame 106 can remain within the dispenser 200 during the dispensing period and can be accessed and removed after some or all of the covers 102 can been dispensed.

When the cartridge 100 is loaded into the dispenser 200, a central platform 222 mounted on the base plate 204 projects upwardly into a lower recess 108 of the cartridge (see FIG. 8). When the shoe covers 102 are expanded within the dispenser 200, a switch or sensor (e.g., pressure sensitive switch 224) coupled to the top of the platform 222 is pressed up against the lower surface of the stack of shoe covers 102. In this position, the switch 224 can sense the presence of the users foot/shoe, such as by sensing the additional pressure applied to the top of the stack of covers 102 by a shoe pressing down on the covers, triggering the release of the top cover 102 over the shoe. When the shoe is removed, the switch 224 can trigger the next shoe cover 102 to be moved into position for dispensing.

The mechanism 202 can include various components and features to cause the posts 206 to move diagonally between the loading position and the dispensing position. To move the posts 206 diagonally apart from the loading position, the controller at 252 causes a motor 212 to rotate the auger 210 in a first direction. The auger 210 is mounted for rotational motion by a bearing in the central platform 222 and an end bearing 226. The auger 210 can also include a gear 228 that can engage a control device to optionally prevent the auger from rotating in one direction or both directions. The auger 210 includes two threaded sections, such as with opposite threading, that each engage with one of two threaded brackets 214, one of the brackets being located on each side of the central platform 222 and each bracket being coupled to two of the posts 206. As the auger 210 rotates, the brackets 214 move linearly apart from each other along the auger. Each bracket 214 includes two slots 218 oriented perpendicular to the auger 210, with the two slots 218 of each bracket located on opposite sides of the auger.

Each of the four slots 218 is engaged with a respective one of four carriages 216 that carry the four posts 208. Each carriage 216 extends through the respective slot 218 and is coupled to the respective bracket 214 such that the carriage 216 is forced to move in the longitudinal direction of the auger (the "x-direction") along with the motion of the respective bracket 214 in the x-direction, while being free to slide along the length of the slot 218 perpendicular to the auger (the "y-direction"). The vertical longitudinal direction of the posts 206 is the "z-direction."

Each carriage 216 can include a lower flange 217 that is mounted in a respective one of four diagonally disposed channels 208 in the base plate 204. As the auger 210 rotates and drives the brackets 214 away from each other in the x-direction, the brackets 214 drive the carriages 216 along the channels 208, allowing the carriages to slide along the slots 218 in the y-direction as the lower flanges 217 of the carriages 216 moved along the channels 208, such that the carriages and the posts 206 move in both the x-direction and the y-direction simultaneously as controlled by the path of the channels.

In some embodiments, each post 206 can also rotate through individual motors 230 mounted to the respective carriage 216 adjacent to the post. Each of the four motors 230 can drive a gear 232, which drives a gear 234 mounted around the base of the post 208, which causes the post to rotated about its vertical z-axis relative to the carriage 216. This rotation of the post 206 turns threads incorporated into the outer surface of the post, which drives the column of clips 104 mounted around the post into a compressed stack.

Figure 15:
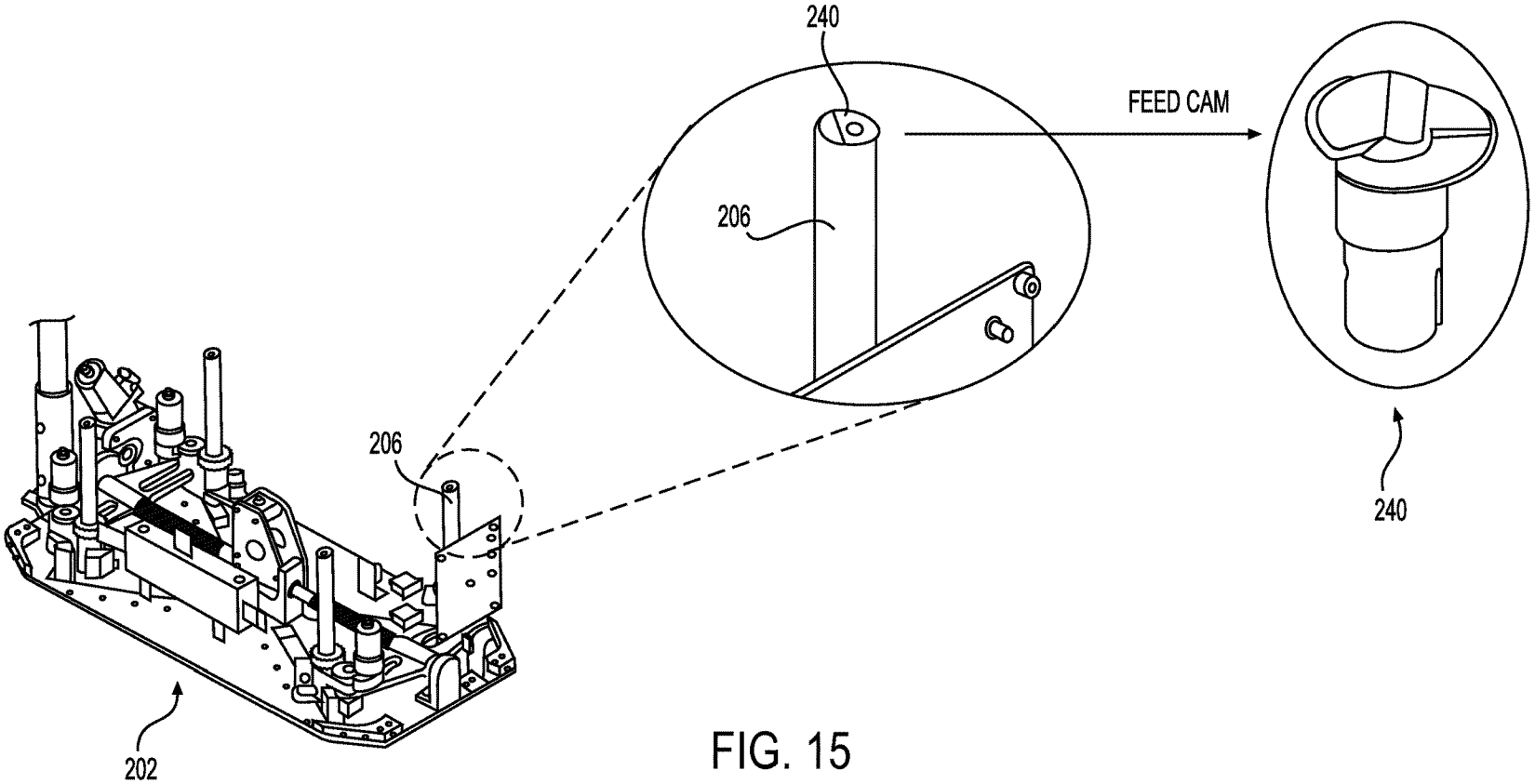
FIG. 15 shows the location of an exemplary feed cam of the mechanism of FIG. 10.
Figure 16:
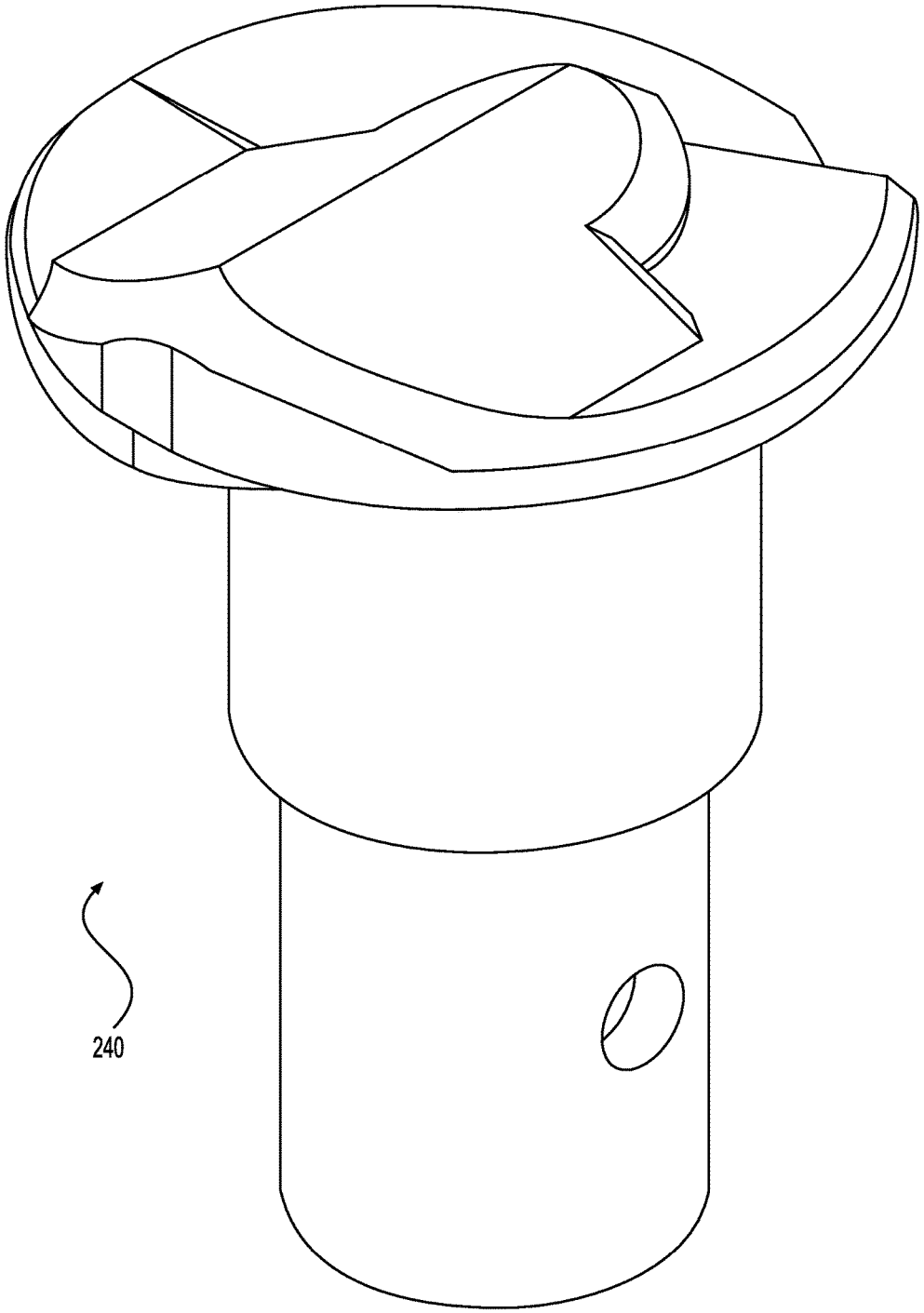
FIG. 16 is a perspective view of the feed cam of FIG. 15.
Figure 17B:
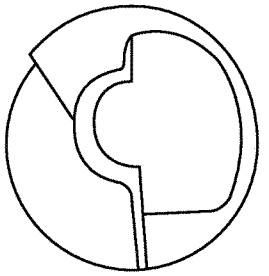
FIGS. 17A, 17B, 18A, 18B, 19A, and 19B show various side and top view of the feed cam of FIG. 15.
Figure 17A:
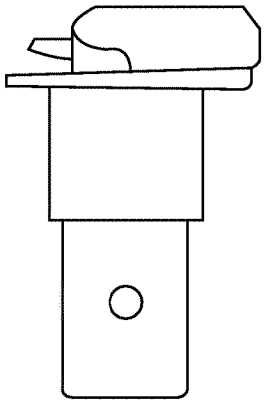
Figure 18B:
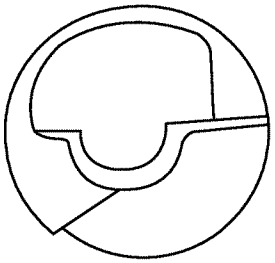
Figure 18A:
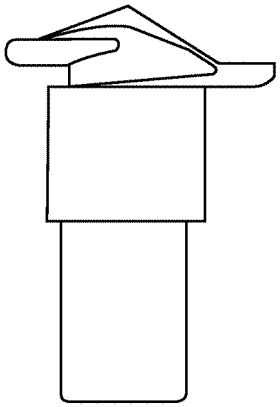
Figure 19B:
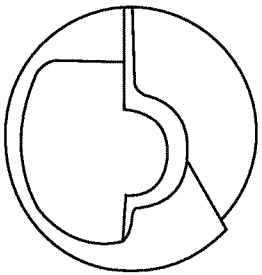
Figure 19A:
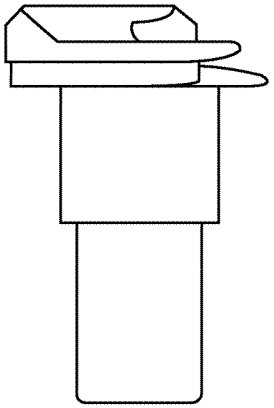
Figure 22:
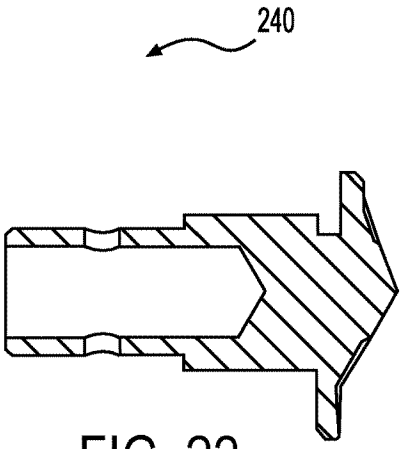
FIG. 22 is a cross-sectional view of the feed cam taken along section line A-A of FIG. 20.
Figure 21:
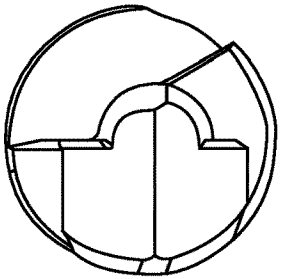
FIG. 21 is a top view of the feed cam of FIG. 15.
Figure 20:
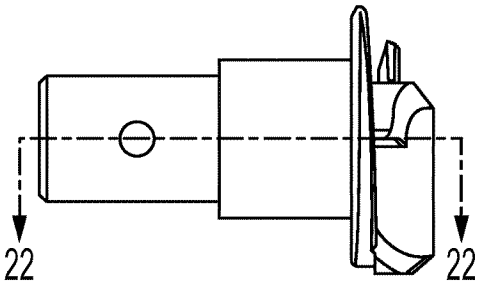
FIG. 20 is a side view of the feed cam of FIG. 15.
Figure 24:
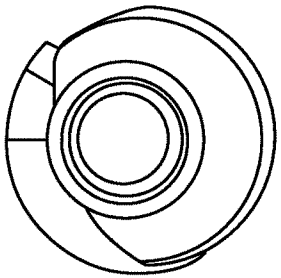
FIG. 24 is a bottom view of the feed cam of FIG. 15.
Figure 23:
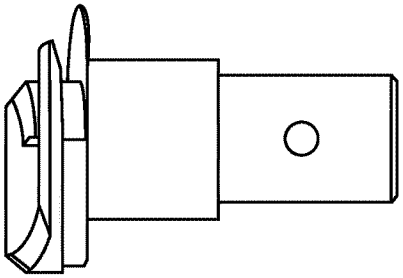
FIG. 23 is a side view of the feed cam of FIG. 15 showing the opposite side of FIG. 20.

As shown in FIG. 15, at the top of each post 206 is a feed cam 240 (illustrated in detail in FIGS. 16-24) that rotates independently of the rotation of the post 206. The rotation of the feed cam 240 allows one clip 104 (the top most clip) to be released after the switch 224 is triggered, and sets the dispense cycle in motion. Each feed cam 240 can be mounted on a vertical rod extending through the post and coupled to a gear 244 (FIG. 13) near the base of the post, which is driven by an individual motor 242 carried by the carriage 214. There can be four motors 242 that drive the rotation of each of the four feed cams 240.

After reaching the expanded, dispense position (FIGS. 13-14) with the covers 104 expanded, the dispenser 200 rotates the four posts 206 to raise the four columns of clips 104 to the top of each post against the feed cam 240. The dispenser 200 then rotates the top feed cams 240 to load only the top clips 104 into the dispense position, then rotates the feed cam 240 the opposite direction to pull the remaining clips down, out of the way for the four top clips to be the only clips to release. When the switch 224 is activated by a shoe, the feed cams 240 rotate to release the four top clips 104 dispense the top shoe cover 102 such that the elastic band causes the cover to snap around the shoe. The posts 206 then rotate to push the clips up to the feed cam 240 again, and the feed cam rotates to load the four top clips again in preparation to dispense the next shoe cover. This cycle can repeat until all the covers are dispensed. When the shoe cover stack is empty, pushing a switch on the dispenser 200 causes the posts 206 to move back inward to the load position by rotating the auger 210 in the opposite direction.

As a precautionary feature, the dispenser can include a "Clear Function" button or switch in case a cover gets caught on a shoe or fails to properly feed. Pushing this switch causes the posts to partially move inward. The feed cams rotate allowing the user to remove the shoe cover in question. The dispenser can then be put back into the dispense position.

Figure 13:
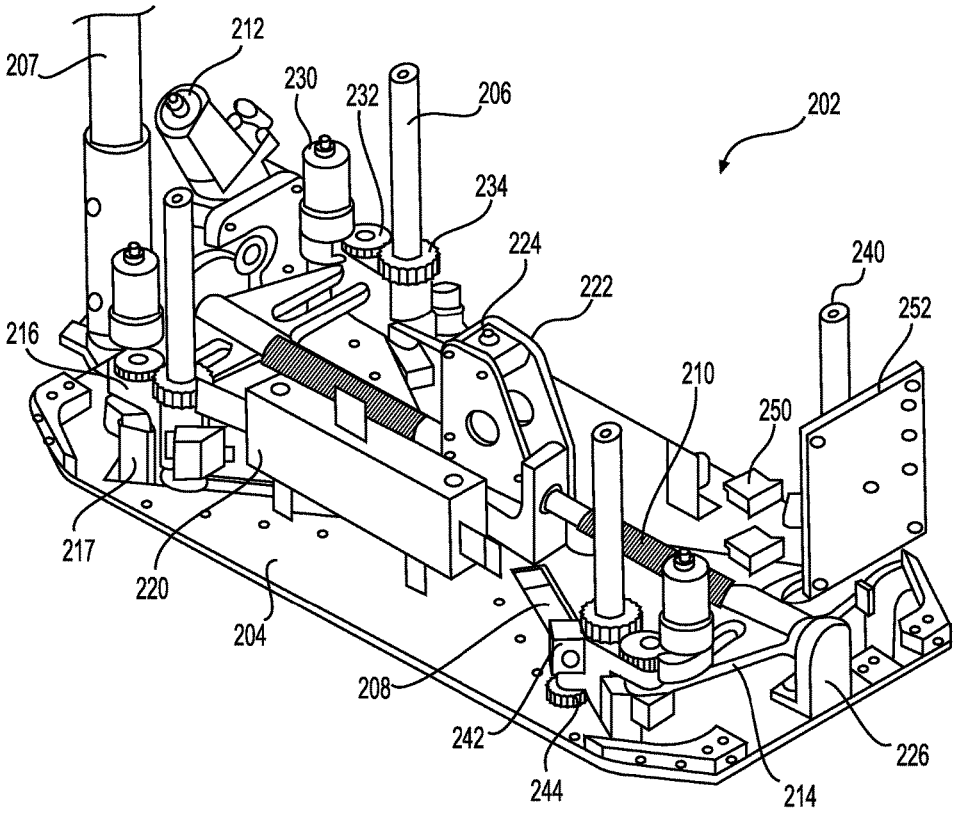
FIG. 13 is a perspective view of the mechanism of FIG. 10 in an expanded position.
Figure 14:
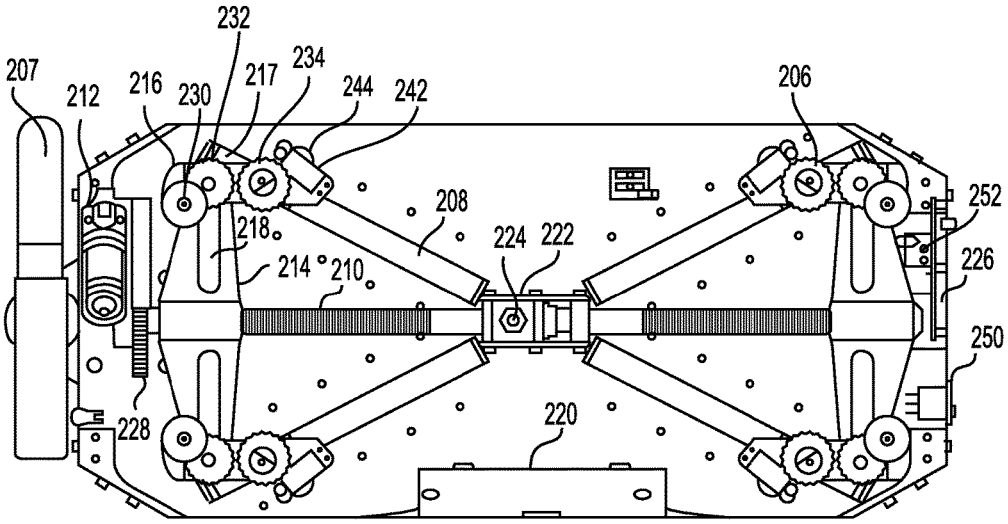
FIG. 14 is a top view of the mechanism of FIG. 10 in the expanded position.

The electronic controls for the dispenser can include LEDs, such as on the board 252 as shown in FIG. 13, to assist in identifying the dispenser functions in process. For example, a "green" light can indicate the system is ready to dispense, a "yellow" light can indicate that the system is ready to load a cartridge, a flashing "green" can indicated that the dispenser is expanding a cartridge, a flashing "yellow" can indicated that the dispenser is collapsing towards the load position, and/or a "red" light can indicate a fault situation with a miss-fed shoe cover (e.g., Clear Function required).

The dispenser 200 can also have a stabilizing handle 207 (FIG. 9) which attaches to the back of the dispenser and extends upward to a height which easily allows the user to grasp the handle. This provides the user the ability to balance on one foot as the other foot is placed within the dispenser.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language. For example, operations described sequentially may in some cases be rearranged or performed concurrently. Moreover, for the sake of simplicity, the attached figures may not show the various ways in which the disclosed methods can be used in conjunction with other methods.

As used herein, the terms "a", "an" and "at least one" encompass one or more of the specified element. That is, if two of a particular element are present, one of these elements is also present and thus "an" element is present. The terms "a plurality of" and "plural" mean two or more of the specified element. As used herein, the term "and/or" used between the last two of a list of elements means any one or more of the listed elements. For example, the phrase "A, B, and/or C" means "A," "B," "C," "A and B," "A and C," "B and C" or "A, B and C." As used herein, the term "coupled" generally means physically coupled or linked and does not exclude the presence of intermediate elements between the coupled items absent specific contrary language.

In view of the many possible embodiments to which the principles of the disclosed invention may be applied, it should be recognized that the illustrated embodiments are only preferred examples of the invention and should not be taken as limiting the scope of the invention. Rather, the scope of the invention is at least as broad as the following claims. We therefore claim all that comes within the scope of the following claims.

The invention claimed is:

1. A shoe cover dispensing system comprising:

a rigid body having an upper opening configured to receive a cartridge containing a plurality of pre-stacked shoe covers in a collapsed state;

an expansion system configured to elastically expand the received plurality of shoe covers in a received cartridge from the collapsed state to an expanded state; and a releasing system configured to detect the presence of a shoe within the body and automatically release one of the plurality of shoe covers from the expanded state such that the released shoe cover elastically closes around the detected shoe;

wherein the expansion system comprises a plurality of poles that extend generally vertically and are configured extend into a received cartridge of shoe covers; and wherein the expansion system includes at least one motor that drives the plurality of poles apart from each other to expand the shoe covers.

2. The system of claim 1, wherein the releasing system comprises a sensor or switch that detects the presence of a shoe positioned inside the body.

3. The system of claim 1, wherein the releasing system comprises at least one rotating feed cam that is configured to release at least a portion of a shoe cover when the feed cam rotates.

4. The system of claim 1, wherein the releasing system is configured to detect that a shoe has been removed from the body after a shoe cover has been released onto the shoe, and the releasing system is further configured to move another shoe cover of the plurality of shoe covers into a position ready to be released onto another foot that is subsequently placed into the body.

5. The system of claim 1, wherein the plurality of poles are configured to enter respective stacks of shoe cover clips in the cartridge.

6. The system of claim 1, wherein the expansion system include at least one motor that drives the plurality of poles apart from each other in a first horizontal dimension and at least a second motor that drives the plurality of poles apart from each other in a second horizontal dimension that is different from the first horizontal direction.

7. The system of claim 3, wherein the releasing system comprises at least one motor that rotates the at least one feed cam.

8. The system of claim 7, wherein the releasing system comprises a sensor or switch that detects the presence of a shoe positioned inside the body and an electrical controller that receives a signal from the sensor or switch indicating the a shoe is detected inside the body.

9. The system of claim 8, wherein the controller sends a signal to the at least one motor that rotates the at least one feed cam in response to receiving a signal from the sensor or switch that indicates a shoe is present inside the body, thereby causing a shoe cover to be released onto the shoe.

10. The system of claim 1, wherein the expansion system is configured to fracture a frame of the cartridge while expanding the shoe covers.

11. A cartridge for a shoe cover dispensing system, the cartridge comprising:

a plurality of elastically expandable shoe covers in a non-expanded state; and a disposable frame positioned at least partially around the shoe covers, the disposable frame configured to contain the shoe covers in a stacked relationship in the non-expanded state and configured to permit the shoe covers to be expanded from the non-expanded state to an elastically expanded state by a shoe cover dispensing system;

wherein the disposable frame comprises at least one weakened portion that is configured to fracture when the shoe covers are expanded by a shoe cover dispensing system from the non-expanded state to an elastically expanded state.

12. The cartridge of claim 11, wherein each of the plurality of shoe covers comprises two or more rings coupled to an elastic portion of the shoe cover, and the rings are stacked in columns.

13. The cartridge of claim 12, where each column of stacked rings comprises at least two different types of rings in an alternating order.

14. A shoe cover dispensing system comprising:

a rigid body having an upper opening configured to receive a cartridge containing a plurality of pre-stacked shoe covers in a collapsed state;

an expansion system configured to elastically expand the received plurality of shoe covers in a received cartridge from the collapsed state to an expanded state; and a releasing system configured to detect the presence of a shoe within the body and automatically release one of the plurality of shoe covers from the expanded state such that the released shoe cover elastically closes around the detected shoe;

wherein the releasing system comprises at least one rotating feed cam that is configured to release at least a portion of a shoe cover when the feed cam rotates; and wherein the releasing system comprises at least one motor that rotates the at least one feed cam.

15. The system of claim 14, wherein the releasing system comprises a sensor or switch that detects the presence of a shoe positioned inside the body and an electrical controller that receives a signal from the sensor or switch indicating the a shoe is detected inside the body.

16. The system of claim 15, wherein the controller sends a signal to the at least one motor that rotates the at least one feed cam in response to receiving a signal from the sensor or switch that indicates a shoe is present inside the body, thereby causing a shoe cover to be released onto the shoe.

17. The system of claim 14, wherein the releasing system comprises at least one rotating feed cam that is configured to release at least a portion of a shoe cover when the feed cam rotates.

18. A shoe cover dispensing system comprising:

a rigid body having an upper opening configured to receive a cartridge containing a plurality of pre-stacked shoe covers in a collapsed state;

an expansion system configured to elastically expand the received plurality of shoe covers in a received cartridge from the collapsed state to an expanded state; and a releasing system configured to detect the presence of a shoe within the body and automatically release one of the plurality of shoe covers from the expanded state such that the released shoe cover elastically closes around the detected shoe;

wherein the expansion system is configured to fracture a frame of the cartridge while expanding the shoe covers.

19. The system of claim 18, further comprising a cartridge containing a plurality of pre-stacked shoe covers in a collapsed state, the cartridge being received by the upper opening of the rigid body, wherein the frame of the cartridge comprises at least one weakened portion that is configured to fracture when the shoe covers are expanded by the expansion system from the non-expanded state to an elastically expanded state.

20. The shoe cover dispensing system of claim 19, wherein each of the plurality of shoe covers in the cartridge comprises two or more rings coupled to an elastic portion of the shoe cover, and the rings are stacked in columns.

* * * * *